United States Patent [19]

Kamp

[11] 4,216,899

[45] Aug. 12, 1980

[54] PLASTIC BAG HANDLE CONSTRUCTION

[75] Inventor: Ewald A. Kamp, Chicago, Ill.

[73] Assignee: Union Carbide Corporation, New York, N.Y.

[21] Appl. No.: 972,427

[22] Filed: Dec. 22, 1978

[51] Int. Cl.[2] ..... B65D 33/02; B65D 33/08

[52] U.S. Cl. ..... 229/54 R; 229/55

[58] Field of Search ..... 229/54 R, 55; 206/806; 150/12

[56] References Cited

U.S. PATENT DOCUMENTS

| | | | |
|---|---|---|---|
| 3,180,557 | 4/1965 | Thulin | 229/54 R |
| 3,339,825 | 9/1967 | Grerich | 229/54 R X |
| 3,568,576 | 3/1971 | Lehmacher | 229/54 R X |
| 3,720,141 | 3/1973 | Stock | 229/54 R X |
| 3,774,837 | 11/1973 | Franson | 229/54 R |
| 3,858,789 | 1/1975 | Verbeke | 150/12 |
| 3,987,959 | 10/1976 | Deards et al. | 229/54 R |
| 4,031,815 | 6/1977 | Verbeke | 93/33 H |

FOREIGN PATENT DOCUMENTS

| | | | |
|---|---|---|---|
| 1457232 | 3/1970 | Fed. Rep. of Germany | 229/54 R |

*Primary Examiner*—Stephen P. Garbe

*Attorney, Agent, or Firm*—Fred Ian Nathanson

[57] ABSTRACT

A plastic bag having a reinforcing flap formed by folding the bag side wall material upon itself at the upper portion of the bag, a cut out portion in the reinforcing flap defining a carrying handle for said bag and a plurality of weld lines on each side of the carrying handle.

9 Claims, 3 Drawing Figures

FIG.1
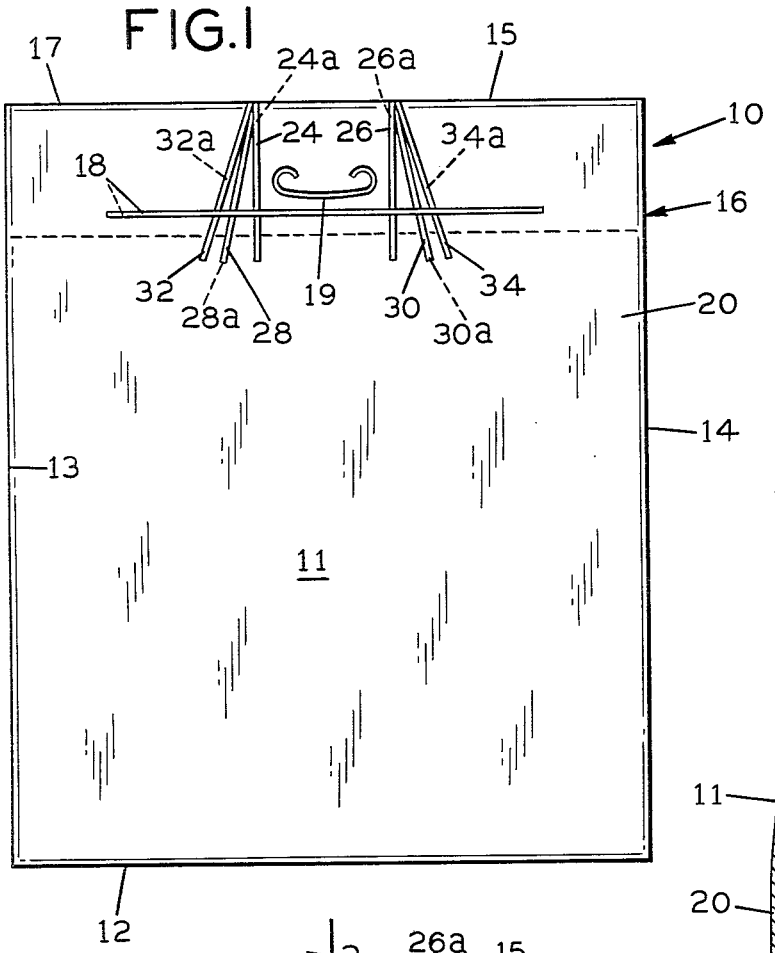
FIG.3
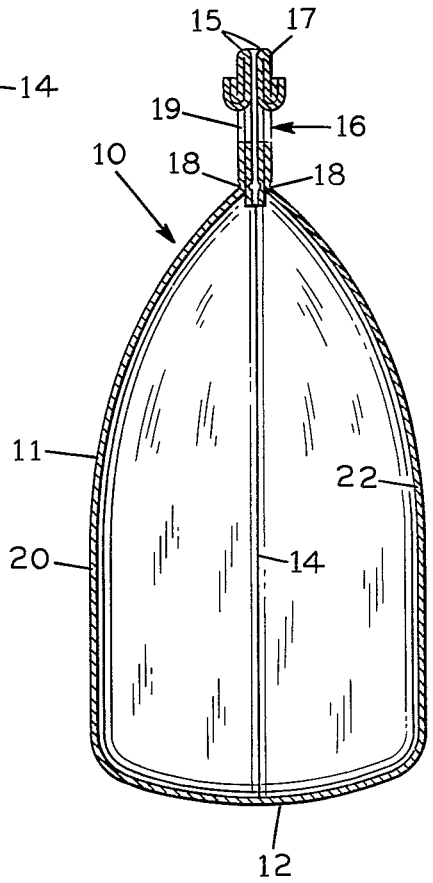
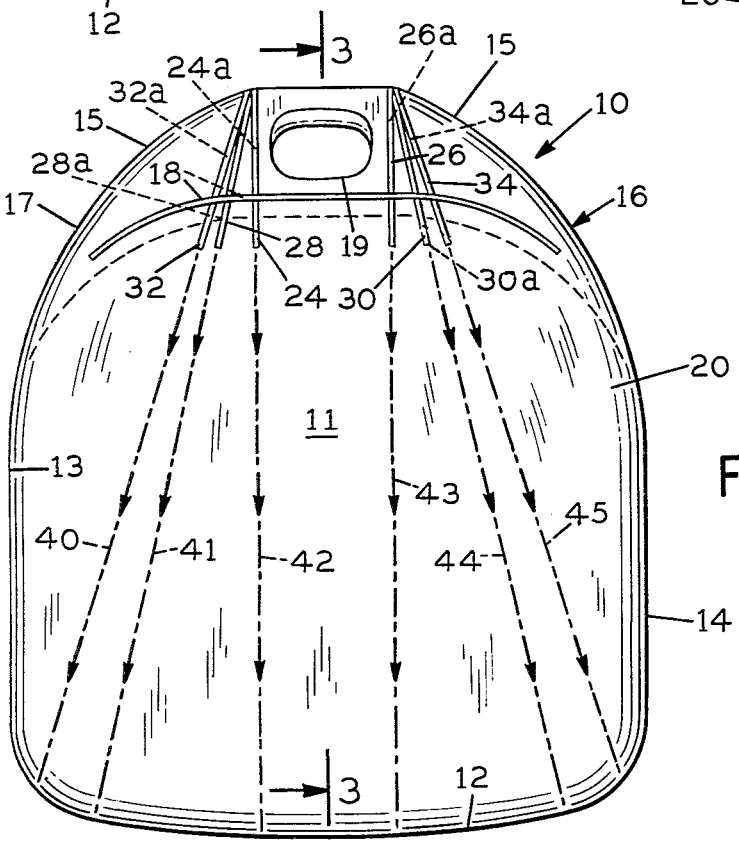
FIG.2

PLASTIC BAG HANDLE CONSTRUCTION

The present invention relates to a bag of weldable plastic material such as polyethylene, polypropylene or the like. In a more specific aspect, the present invention relates to a bag of weldable plastic material having a novel plastic handle construction.

As is well known to those skilled in the art, there are presently available a wide variety of plastic bags which can be used to package and store foods and to carry loose articles, etc. The most widely used plastic bags are those fabricated from polyolefins, particularly polyethylene. In general, these plastic bags are waterproof, mildew resistant and unlike paper bags, possess a degree of elongation which reduces the tendency of tearing and/or ripping.

At present there are countless ways in which plastic bags or sacks can be equipped to hold loads by carrying them from the top of the bag. In general, most of the plastic bags serving as tote bags that have been available to date are provided with a variety of handles, including a die cut handle, a die cut and reinforced handle, or a separate fabricated handle attached to the bag, either mechanically or by heat sealing. Of the above types, the most common is a die cut handle in which the side walls of the bag are folded over at the top to form a double thickness of plastic material at the top, which is die cut to form a punched out handle.

In many instances the fold-over is heat sealed to the side-wall. Such handles generally are quite adequate for limited loads and reasonably heavy film gauges, e.g., 2.5–3 mils. However, it is today quite feasible to construct 5 gal. size bags strong enough to carry 40 lbs. in 1.5–2.0 mil gauges. Such bags or sacks are being manufactured but with a reinforcing film measuring $3\frac{1}{2}\times 6$ inch heat sealed to the side walls in the handle region. Such additional add-ons are costly, slow down the conversion machines and are generally practical only in the perspective of even worse options.

Accordingly, it is an object of the present invention to provide a plastic bag having side walls folded over at the top to form a double thickness plastic material at the top which is die cut to form a punched out handle.

Another object is to provide a die cut handle for a plastic bag which is capable of supporting relatively large loads without tearing or breaking.

Another object is to provide a handle for a plastic bag which does not require separate reinforcing material as is conventional in the art.

These and other objects will become apparent from the following description taken in conjuction with the accompanying drawing in which:

FIG. 1 is a front view of a plastic bag according to the invention;

FIG. 2 is a front view of a plastic bag illustrating the lines of stress in the bag when subjected to carrying loads.

FIG. 3 is a section taken along the lines 3—3 of FIG. 2.

Broadly contemplated, the present invention provides a plastic bag having a body portion fabricated from a thermoplastic material, said bag being closed at one end and along its sides and being opened at its other end, said open end being characterized in that said body portion is folded upon itself at its open end transversely along a fold line defining the upper edge of said open end of said bag and being adhered to the body portion of said bag to form a reinforcing flap, a cut out portion disposed in said reinforcing flap defining a carrying handle for said bag and a plurality of weld lines on each side of said carrying handle extending across the width of said reinforcing flap, said weld lines nearest the carrying handle extending generally perpendicular to the top and bottom of said bag and said weld lines more remote from said carrying handle being directed obliquely toward the lower corners of said bag.

More specific aspects of the invention are described with reference to the accompanying drawing. Thus referring to the drawing and particularly FIG. 1 thereof, reference numeral 10 designates one type of bag contemplated by the present invention which is provided with a body portion 11 fabricated from a thermoplastic or flexible heat sealable sheet plastic material such as polyethylene. The preferred plastic material is a mixture containing not less than about ten percent high density polyethylene admixed with low density polyethylene, which for proper strength should be of a thickness of about 1.5 mil and most preferably about 2 mil thickness. Film thickness can, of course, be varied to accomodate the intended superimposed load which the bag must carry.

The body portion 11 can be fabricated from a flat seamless tube made, for example, in well-known manner by extruding polyethylene around a bubble of air and thereafter sealing one end of the tube to form the bottom end 12 of the bag 10. The body portion 11 can also consist of a single web of sheet plastic material folded upon itself with the fold crease defining the bag bottom and with heat sealed seams forming the side edges 13 and 14, or it can be a bag consisting of two superposed webs of sheet plastic material having longitudinal heat-sealed seams at the side margins 13 and 14 and a transverse heat-sealed seam forming the bottom end 12 of bag 10. Thus the body portion of the bag 10 can be constructed in a variety of ways, the ultimate result being that the bag illustrated in FIG. 1 is closed at one end, i.e. the bottom end 12, closed along its sides 13 and 14, and has an open end represented by reference numeral 15. The upper portion of the body portion 11 is folded upon itself so as to form a reinforcing flap 16 extending around the full periphery of the bag 10 adjacent to its open end 15. Referring again to FIGS. 1 and 2, it will be seen that the flap 16 constitutes the upper end of the body portion 11 which is folded upon itself transversely along fold line 17 defining the upper edge of the open end of bag 10.

The folded over body portion constituting the flap can be adhered to the main body portion of the bag by any suitable means but preferably the point of attachment constitutes an area of adhesion extending transversely across the lower portion of the flap as indicated by reference numeral 18 in the drawing. Any conventional type of adhesive suitable for adhering thermoplastic materials can be employed to form the transverse adhesive lines of attachment. Since the body portion 11 is of the same material (thermoplastic) as the flap 16, the attachment can also be achieved by heat-sealing the materials in the desired area. Thus as used herein, adhesive attachment is meant to include heat-sealing.

The vertical height of the flap 16 of bag 10 would depend of course on the size of the bag, the type of articles to be carried, the weight of the contents of the filled bag and other variables. Since the flap, when in use as a carrying handle, is to support the contents of the bag, the larger sized bags will generally have a proportionately larger flap as compared to the flap formed on smaller sized bags. Merely as illustrative, a bag measuring about eighteen inches vertically from the closed end to the open end of the bag, and eighteen inches across from side margin to side margin would utilize a flap measuring about 1¼ inches in height. In any event, the required size of the flap can be easily determined by one skilled in the art, taking into consideration the above mentioned variables, and hence no detailed discussion of the appropriate size is necessary.

Thus, as will be seen in FIG. 1, the opening end of the carrier bag 10 is reinforced by the reinforcing flap 16. Disposed approximately in the center of the reinforcing flap 16 are two oppositely disposed carrying grip openings defining a carrying handle 19 which can be formed by the die punch-out technique or by a slitting operation, as is well known in the prior art. The carrier grip openings defining carrying handle 19 are preferably elongated "U" or rotated "C" shaped openings which are of a size sufficient to accommodate the fingers of an individual.

Referring to FIG. 2, it will be seen that when a plastic bag is subjected to a carrying load, certain lines of strain are imposed upon the bag such as lines 40, 41, 42, 43, 44 and 45. Under certain conditions, e.g., when carrying bulky or excessive loads, rips, tears or ruptures of the bag at the site of the carrying handles may occur due to the stresses imposed along the lines of strain. According to the present invention, provision is made to reduce or prevent the bag from failing proximate the carrying handle by providing a plurality of weld lines on each side of the punched out handle which extend over the width of the reinforcing flap and which approximate the lines of strain of the carrying bag under load. Thus, referring again to FIGS. 1 and 2, it will be seen that the reinforcing flap 16 is provided in this embodiment with twelve straight weld lines, with three straight weld lines, disposed on each side of carrying handle 19 on the front wall 20 of the bag 10, and three straight weld lines disposed on each side of the punched out handle on the back wall 22 of the bag. The weld lines 24, 26 and **24*a*, 26*a* respectively, i.e. the inner weld lines which are nearest the carrying handle, extend generally perpendicular to the top and bottom of the bag and preferably extend from the fold line 17 of reinforcing flap 16 through the bottom weld line 18**.

The weld lines can be formed by any conventional technique and constitute material from both inner and outer surfaces of reinforcing flap 16 welded together by heat sealing or by the use of adhesives. Weld lines 28, **28*a* and 30, 30*a*, i.e. the middle weld lines, are positioned adjacent the inner weld lines and extend obliquely from, preferably, fold line 17 towards the lower corners of the bag terminating either through, immediately proximate, or on lower weld line 18**.

In like manner, weld lines 32, **32*a* and 34, 34*a***, i.e. the outer weld lines, are positioned adjacent the middle weld lines and they also are directed obliquely towards the lower corners of the bag at a greater angle than the middle weld lines with respect to the inner weld lines.

Although the weld lines, as shown in the drawings, extend from fold 17 through lower weld line 18, this is not critical although it is preferable. Thus the weld lines can extend from a point immediately below fold line 17 and can terminate immediately prior to lower weld line 18. For best results the weld lines should be substantially continuous and substantially straight. It has been observed that the weld lines as provided for according to the present invention, result in an increase in strength of the carrying handle in the order of 20 to 25 percent.

Although the present invention has been disclosed with a carrying bag not provided with bottom gussets, it will nevertheless be understood that the invention can be practiced with carrying bags provided with side or bottom gussets, as is conventional in the art.

The vertical height of the flap 16 of bag 10 would depend of course on the size of the bag, the type of articles to be carried, the weight of the contents of the filled bag and other variables. Similarly, the number of weld lines which are used to reinforce the handle will vary with the size of the bag and the load to be carried. The larger sized bags will generally have a proportionately larger flap as compared to the flap formed on smaller sized bags and will have a greater number of weld lines on each side of the handle. In general, the number of weld lines will range from one to five on each side of the handle opening.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A plastic bag comprising a front wall and a back wall fabricated from a thermoplastic material, said bag being closed at one end and along its sides and being opened at its other end, said open end being characterized in that a portion of said front wall is folded upon itself at said open end transversely along a fold line defining the upper edge of said open end of said bag and being adhered to the unfolded portion of said front wall to form a first reinforcing flap, and a portion of said back wall is folded upon itself at said open end transversely along a fold line defining the upper edge of said open end of said bag and being adhered to the unfolded portion of said back wall to form a second reinforcing flap, a cut out portion disposed in each of said reinforcing flaps and said front and back walls defining a carrying handle for said bag and a plurality of weld lines on each side of said cut out handle extending over at least a portion of the width of each of said reinforcing flaps, said weld lines nearest the carrying handle extending generally perpendicular to the top and bottom of said bag and said weld lines more remote from said carrying handle being directed obliquely toward the lower corners of said bag.

2. A plastic bag according to claim 1 wherein said thermoplastic material is polyethylene.

3. A plastic bag according to claim 1 wherein said plastic material is a mixture containing at least about ten percent high density polyethylene admixed with low density polyethylene.

4. A plastic bag according to claim 1 wherein said cut out portion is of a rotated C-shaped configuration.

5. A plastic bag according to claim 1 wherein said weld lines constitute an inner weld line, an outer weld line, and at least one middle weld line disposed on each side of said carrying handle.

6. A plastic bag according to claim 1 wherein said folded portion is adhered to said body portion by a lower transverse weld line and said weld lines on each side of the handle extend from said fold line through said lower transverse weld line.

7. A plastic bag according to claim 1 wherein said weld lines are substantially straight and continuous weld lines.

8. A plastic bag according to claim 1 wherein at least one weld line is formed by the application of adhesive.

9. A plastic bag according to claim 1 wherein at least one weld line is formed by the formation of a heat seal.

* * * * *